US005178128A

United States Patent [19]

Krieger

[11] Patent Number: 5,178,128

[45] Date of Patent: Jan. 12, 1993

[54] METHOD AND APPARATUS FOR CLAMPING INCINERATOR GRATE BARS

[75] Inventor: Friedrich Krieger, Würzburg, Fed. Rep. of Germany

[73] Assignee: Noell K+K Abfalltechnik, Neuss, Fed. Rep. of Germany

[21] Appl. No.: 829,939

[22] Filed: Feb. 3, 1992

[30] Foreign Application Priority Data

Feb. 18, 1991 [DE] Fed. Rep. of Germany ..... 4105331

[51] Int. Cl.[5] ..... F23H 7/08; F23H 7/14

[52] U.S. Cl. ..... 126/175; 110/281; 126/152 B; 126/174

[58] Field of Search ..... 126/152 R, 174, 175, 126/152 A; 152 B; 110/281, 282, 283, 284

[56] References Cited

U.S. PATENT DOCUMENTS

| | | | |
|---|---|---|---|
| 4,018,168 | 4/1977 | Andreoli et al. | 126/174 X |
| 4,328,786 | 5/1982 | Owen | 126/174 |
| 4,676,176 | 6/1987 | Bonomelli | 110/281 |

FOREIGN PATENT DOCUMENTS

| | | |
|---|---|---|
| 0165432 | 12/1985 | European Pat. Off. . |
| 12652475 | 5/1978 | Fed. Rep. of Germany . |
| 13813441 | 11/1988 | Fed. Rep. of Germany . |
| 585372 | 2/1977 | Switzerland . |
| 619764 | 10/1980 | Switzerland . |

*Primary Examiner*—Edward G. Favors

*Attorney, Agent, or Firm*—Cohen, Pontani, Lieberman, Pavane

[57] ABSTRACT

A grate bar assembly for use in a combustion furnace, particularly, in a waste incinerator having a combustion chamber, includes a plurality of overlapping rows of grate bars extending across the combustion chamber, each row of grate bars being composed of a plurality of juxtaposed grate bars; a grate bar support; and a preferably hydraulically operated releasable clamping device disposed outside the combustion chamber for laterally clamping the plurality of overlapping rows of grate bars and for moving the juxtaposed grate bars toward each other. A method of operating the grate bar assembly is also disclosed.

12 Claims, 3 Drawing Sheets

METHOD AND APPARATUS FOR CLAMPING INCINERATOR GRATE BARS

FIELD OF THE INVENTION

The present invention relates to grate bars and specifically to an apparatus and method for adjusting the lateral clearance of grate bars used in combustion furnaces, in particular, rubbish incinerators.

BACKGROUND OF THE INVENTION

Grates in the combustion chamber of a combustion furnace are typically comprised of a plurality of rows of grate bars which form at least a portion of the floor of the combustion chamber. The rows of grate bars are typically laid so that each row at least partially overlaps another row in the same way that rows of roofing shingles or tiles overlap one another.

Various different types of grate bars are used in waste incinerators. Larger installations frequently utilize clamped or pressed grates.

However, when the grate bars used are not clamped or pressed into position, the grate bars generally are positioned in rows in the combustion chamber so that they have a lateral clearance for thermal expansion, as disclosed in German Patent Document No. A1-26 52 475. The expansion clearance for these grate bars is generally distributed as spaces or air gaps in a non-uniform manner over the entire width of the grate. Along the sides of the grate proximate to the walls of the combustion chamber, there is generally an additional space or air gap to provide further expansion clearance. In these conventional grates, the air gap between the grate bars provides access for an uncontrolled flow of air to the material being incinerated in the combustion chamber of the furnace.

In an attempt to solve this problem, adjacent grate bars have been connected by individual connection elements to form a single gap-free incineration grate surface as described in German Patent Document A1-38 13 441. However, if the temperature of the material being incinerated and the resulting temperature of the grate bars is too high, the grate bars produce stresses which are higher than the connection elements can withstand, and distortions or breakage of the grate bars frequently results.

In addition to the problems of the uncontrolled supply of combustion air, the presence of air gaps or slots between the grate bars provides a location where material being incinerated can enter and pass through, thereby leading to an accumulation of incinerated ash under the grate and, in addition, exposing the various structural parts below the grate to elevated temperatures. Also, materials that melt at a low temperature, such as non-ferrous metal waste and steel scrap, can flow through and become wedged in these gaps, thereby restricting the mobility of the grate bars.

It is also desirable to provide a means for feeding the material into the combustion chamber of the furnace, and for shifting the material in the combustion chamber to ensure that the material is incinerated completely and efficiently. Typically, the feeding and shifting of the incinerator material is accomplished by providing that one or more of the rows of grate bars can slide as an entire row over a stationary, underlying row of grate bars. Swiss Patent Document No. 585,372 discloses such a feed grate for a waste incineration furnace in which rows of grate bars, which extend transverse to the grate, are moveable in the direction of feed of the grate.

As pointed out above, in incinerators used in large plants, frequently the grate bars of the grates are clamped or pressed into position. Swiss Patent Document No. 585,372 additionally describes a grate in which each transverse row of grate bars is provided with a clamping device which operates under spring action. The clamping device is connected to each of the two outermost grate bars of each transverse row of grate bars and urges the two outermost grate bars, and thus the intervening grate bars, toward the center of the transverse row so that any gaps between the grate bars are eliminated. However, because of the large number of moving parts, this spring tension design is usually unable to withstand prolonged use under the hostile conditions present in a high temperature furnace. Additionally, such a device is expensive to manufacture and is not easily controllable.

Swiss Patent Document No. 619,764 discloses an alternative design in which spring loaded spreader elements are positioned between certain of the grate bars. European Patent Document No. B1-0 165 432 discloses a mechanism using plate springs in which grate bars are resiliently connected to one another by a tie rod. However, plate springs cannot reliably provide uniform spring forces over the large temperature range present in the furnace and the high pressures resulting from the thermal expansion of the grate bars and the tie rod. In addition, the springs and various moveable parts must be exposed to the high temperatures of the combustion chamber and to the material being incinerated. Finally, adjustment and control of the tension and repair of the spreader devices can only be accomplished once the grate has fully cooled.

SUMMARY OF THE INVENTION

An object of the present invention is to provide a means and method for ensuring that the grate bars in each row of grate bars abut one another as tightly as possible in a controlled way so that, as a result, no gaps or slots are present between individual grate bars in a row of grate bars. Another object is to provide a means and method for finely adjusting the tightness of the abutment of the grate bars in response to the actual operating conditions of the furnace.

The present invention provides a grate for combustion furnaces, in particular waste incinerators, which have rows of laterally clamped grate bars supported and guided upon associated grate bar supports. The rows of grate bars are preferably laid so that each row at least partially overlaps another row of grate bars, similar to roofing shingles or tiles. Preferably, the grate is comprised of alternating moveable and fixed grate bar rows, the moveable grate bar rows being moveable to feed or shift the material in the combustion chamber. Clamping elements, preferably, hydraulic clamping devices, such as hydraulically driven cylinders, contact one or both of the outermost grate bars in a row of grate bars. The clamping elements are positioned on either side of the incineration furnace but outside of its combustion chamber.

In a preferred embodiment, common counter pressure or resistance side plates, are used which contact the sides of two or more adjacent fixed or moveable grate bar rows thereby absorbing reaction forces directed against the rows of fixed grate bars as well as the stresses acting upon the rows of moveable grate bars. By using the resistance side plates of the present invention, the forces resulting from the thermal expansion of the grate bars do not act upon the wall of the furnace but remain within the grate bar clamping and support system. Each clamping element for each row of grate bars may be controlled individually or, alternatively, several clamping elements associated with several rows of grate bars, either moveable or fixed grate bar rows, can be jointly controlled. As mentioned, counter pressure or resistance side plates may be used which contact and act upon alternate rows of grate bars, for example, only upon the rows of fixed grate bars. The extent of clamping provided by the clamping elements, and thus the degree of tightness of the grate bars, can be determined and monitored by a measuring device, for example, a pin which indicates the position of the outermost grate bar of a grate bar row.

The clamping device of the present invention can be used both with the moveable grate bar rows and also with the fixed grate bar rows. The clamping elements may exert a continuous clamping pressure or, alternatively, a cyclical clamping pressure which coincides with the cyclical motion of the moveable grate bars during the incinerator feeding and shifting process. In this embodiment, the moveable rows of grate bars are preferably clamped when they are stationary and are unclamped when the moveable grate bar row is sliding in the feeding operation, thereby reducing friction between the grate bars and the walls of the furnace.

The clamping device of the present invention permits fine adjustment in the force applied to the grate bars, allows for the elimination of air gaps or slots between abutting grate bars, and can be used when the incinerator is either hot or cold. By using the clamping device of the present invention, air enters the combustion chamber of the furnace only at the air slots specifically designed for this purpose. When a number of the clamping devices of the present invention are used, one for each row of grate bars, the clamping force applied to each row of grate bars can be individually selected and adjusted.

Preferably, the clamping device uses a hydraulic cylinder operated by conventional valves and pressure producing devices. A hydraulically controlled system is preferred, rather than a mechanical system, because it is more able to apply a greater amount of clamping force which is required for very wide furnaces having a large number of grate bars. The clamping device of the present invention allows these hydraulic cylinders to be located outside of the combustion chamber of the furnace so that the hydraulic cylinders need not necessarily be suited for operation in especially high temperature environments.

The total width of all of the grate bars in a row of grate bars can be observed at any time by using a path measurement device such as, for example, a measurement pin with an appropriate scale that contacts, either directly or indirectly, the outermost grate bar of a grate bar row and extends through a hole in the wall of the furnace. By observing the position of the measurement pin relative to its scale, the tightness of the grate bars in that row of grate bars can be readily determined even while the furnace is in operation because the presence of air slots will necessarily cause an increase in the overall width of that row of grate bars. For example, it can easily be determined whether molten non-ferrous metal or steel pieces have unexpectedly entered between grate bars in that row of grate bars thereby producing undesirable air slots.

By reducing the clamping force applied to the moveable grate bars during the stroke of the grate (the time that the material being incinerated is fed and/or shifted), friction between the grate bars and the furnace wall or other elements is reduced and unnecessary wear between the sliding elements of the grate and the sides of the furnace is avoided. Furthermore, by varying the clamping pressure being applied, foreign bodies, such as ash or pieces of steel, which may have accidently slipped between abutting grate bars during the cyclical clamping and unclamping of the grate bars, can be removed. Typically, foreign bodies slip between grate bars when the side or upper surfaces of the grate bars are worn or have been damaged after prolonged operation of the furnace.

In an alternate embodiment, the number of hydraulic cylinders used to control the clamping elements may be minimized by using two hydraulic cylinders, one on each side of the furnace, connected to hydraulic linkages that control more than one clamping element associated with a number of rows of grate bars. Similarly, a single hydraulic cylinder on only one side of the furnace may be connected to clamping elements on both sides of the furnace using a longitudinal linkage that passes the hydraulic action from one side of the furnace to the other.

Additionally, if the width of the grate is not too large, and if the grate is not divided in its center, the clamping force can be applied to the grate bars from only one side of the furnace. In this embodiment, one end of the row of grate bars is fixed while the grate bars proximate to the clamping device can slide. If the grate is divided at its center by a fixed central grate divider, clamping forces are applied to the grate bars on both sides of the furnace.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DESCRIPTION OF THE PRESENTLY PREFERRED EMBODIMENT

Figure 1:
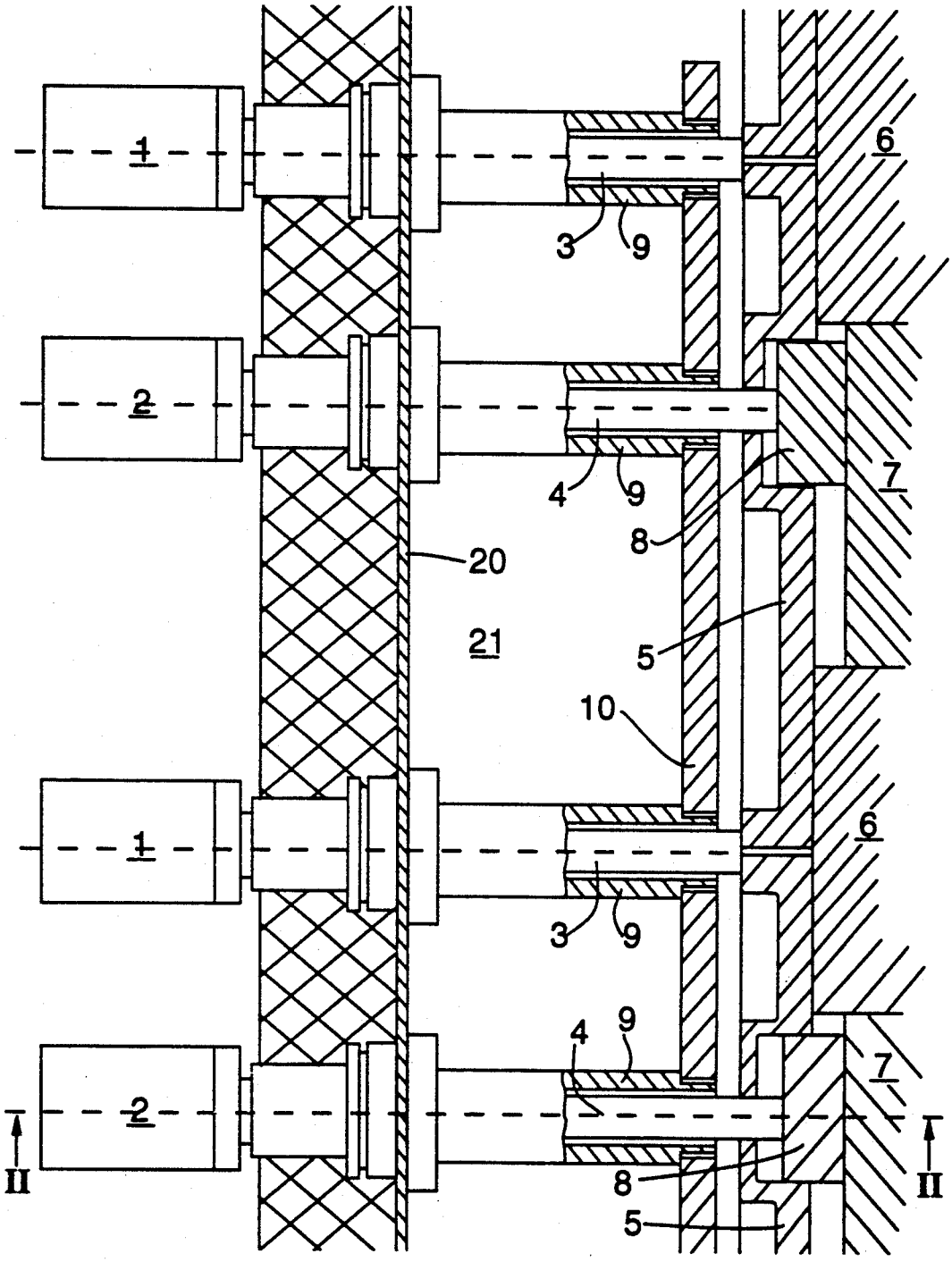
FIG. 1 is a partial cross-sectional view of several clamping devices of the present invention acting upon grate bars.
Figure 2:
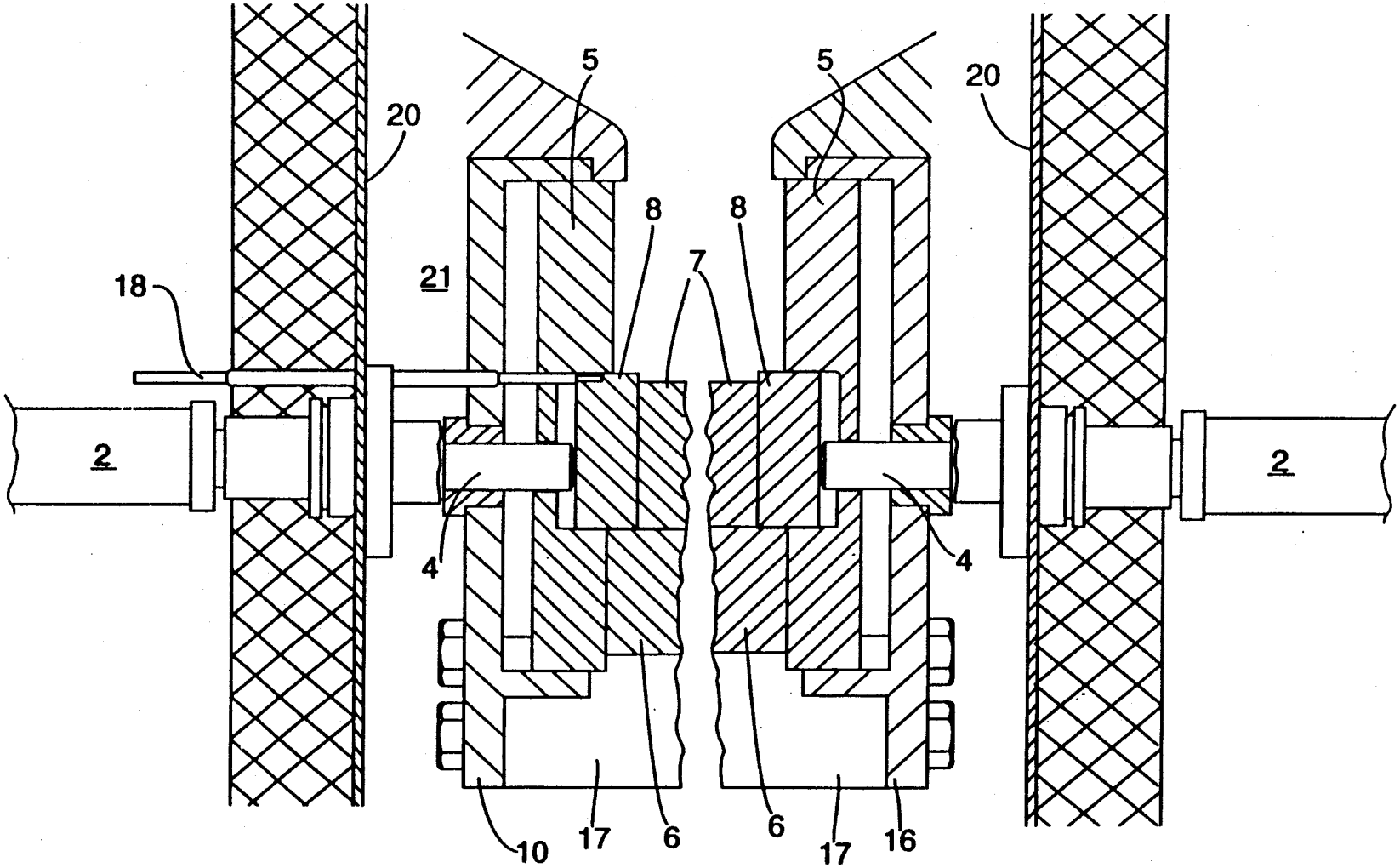
FIG. 2 is a cross-sectional view along the line 2—2 of FIG. 1 showing a single clamping device of the present invention acting upon a moveable row of grate bars.

FIGS. 1 and 2 show the clamping device for an incinerator grate of the present invention mounted to a furnace wall 20 of a combustion chamber 21 of an combustion furnace. Hydraulic cylinders 1, 2 are mounted outside of the combustion chamber 21 and are controlled by hydraulic drives and controls (not shown). As shown in FIG. 2, within combustion chamber 21 fixed grate bar rows 6 rest on grate bar supports 17 which are associated with each row. Moveable grate bar rows 7 lie upon and overlap the fixed grate bar rows 6 in the same way that shingles or tiles lie and overlap one another on a roof. In FIG. 1, the material to be incinerated is fed in an upward direction. The hydraulic cylinders 1, 2 act upon rams 3, 4 which are slidably mounted in guide tubes 9. Guide tubes 9 are mounted into holes in common grate bar support shield 10, preferably so that four adjacent guide tubes 9 are mounted in a single grate bar support shield 10. The grate bar support shield 10 absorbs the counter forces or reaction forces of the cylinder which act upon the rows of grate bars 6, 7 via the tips of the rams 3, 4. Grate bar support shields 10 thus act as counter pressure or reaction plates. Rams 3, 4 are operatively connected to hydraulic cylinders 1, 2, respectively, which clamp fixed grate bar rows 6 and moveable grate bar rows 7, respectively. Rams 3 operate directly upon common side plates 5, each of which contacts two fixed grate bar rows 6 and thus serve as pressure plates by acting directly on two adjacent fixed rows of grate bars, as shown in FIG. 1. By using this arrangement, the clamping force applied to each fixed grate bar row 6 can be individually adjusted, if required, and, additionally, each fixed grate bar row 6 can expand to a different extent relative to another fixed grate bar row. The rams 4 pass through holes in grate side plates 5 and contact sliding pieces 8 which themselves contact the outermost grate bars of moveable grate bar rows 7. Sliding pieces 8 are slidably mounted into grooves in common side plates 5. Similarly, the clamping force applied to any individual moveable grate bar row 7 may be individually adjusted, if desired.

The incineration grate of the present invention can operate as a feed grate so that upon each stroke of the incinerator grate, the moveable grate bar rows 7 slide over the fixed grate bar rows 6. When the moveable grate bar rows 7 are to slide during their cyclical feeding motion, the outermost grate bars of moveable grate bar rows 7 slide past sliding pieces 8. Because the pressure exerted by hydraulic cylinder 2 upon ram 4, sliding piece 8, and moveable grate bar row 7 may be adjusted, the clamping force exerted is preferably reduced during the stroke or sliding movement of moveable grate bar rows 7 to decrease the friction between sliding piece 8 and the outermost grate bar of moveable grate bar rows 7.

As a result of the clamping system of the present invention, each of the fixed grate bar rows 6 and each of the moveable grate bar rows 7 may expand and contract to different extents depending upon their temperatures, while still all being clamped with the same clamping pressure.

FIG. 2 shows a side sectional view of the clamping mechanism shown in FIG. 1 and, additionally, shows clamping mechanisms operating on both ends of the grate bar rows. In FIG. 2, only the outermost grate bars of fixed grate bar rows 6 and moveable grate bar rows 7 are shown, and the intervening center grate bars are eliminated. In the embodiment shown in FIG. 2, where both outermost grate bars of moveable grate bar rows 7 are acted upon hydraulic cylinders 2, the centermost grate bar (not shown) of moveable grate bar rows 7 is preferably fixed. Sliding pieces 8 are mounted within grooves of common side plate 5 which, in turn, are mounted within recesses in grate bars support shields 10, 16. The fixed grate bar row 6 is mounted upon grate bar support 17 which is attached to grate bar support shields 10, 16. Moveable grate bar row 7 is positioned on top of fixed grate bar row 6. Hydraulic cylinders 2 which act upon moveable grate bar row 7 through rams 4 and sliding pieces 8 are fastened to furnace wall 20 so that their operating portions, for example, their hydraulic drive and control mechanisms, are located outside of the combustion chamber 21 of the furnace. In the preferred embodiment shown in FIG. 2, a measurement pin 18 contacts sliding piece 8 and passes through holes in common side plate 5 and grate bar support shield 10 to pass through and beyond furnace wall 20. When sliding piece 8 moves, either by thermal expansion or contraction of the grate bars or by the clamping action of hydraulic cylinders 2, the length of measurement pin 18 extending outside the furnace wall 20 changes. As a result, the position of sliding piece 8, and thus the positions of the grate bars in moveable grate bar row 7, can be monitored from outside of the furnace. Preferably, a scale is associated with the portion of measurement pin 18 extending outside of furnace wall 20 so that numerical values can be associated with the position of sliding piece 8 and the grate bars in the moveable grate bar rows 7. Similarly, measurement pins 18 are preferably also used with the clamping mechanisms associated with fixed grate bar rows 6. In this embodiment, a measurement pin passes through furnace wall 20, grate bar support shield 10, and common grate side plate 5 to directly contact the outermost grate bar of fixed grate bar rows 6. The measurement pins can be connected to conventional electronic devices which provide a reading taken from the measurement pin to a remote location.

Figure 3:
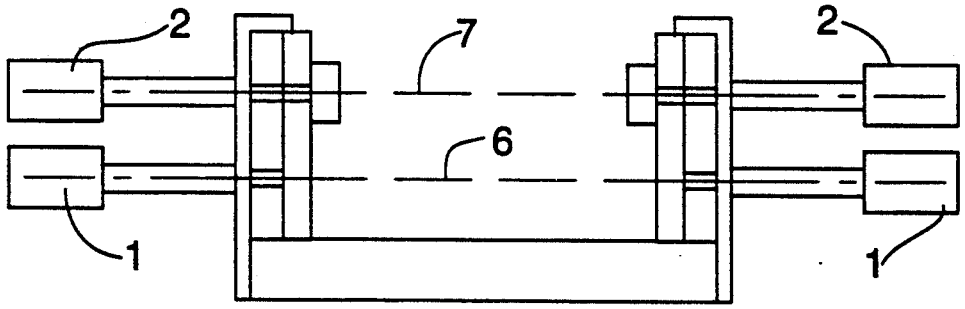
FIGS. 3 through 5 are schematic illustrations showing three further embodiments for controlling a number of the clamping devices of the present invention.

FIG. 3 shows an incineration grate in which fixed grate bar rows 6 and moveable grate bar rows 7 are acted upon by hydraulic cylinders 1, 2 on both sides of the furnace.

Figure 4:
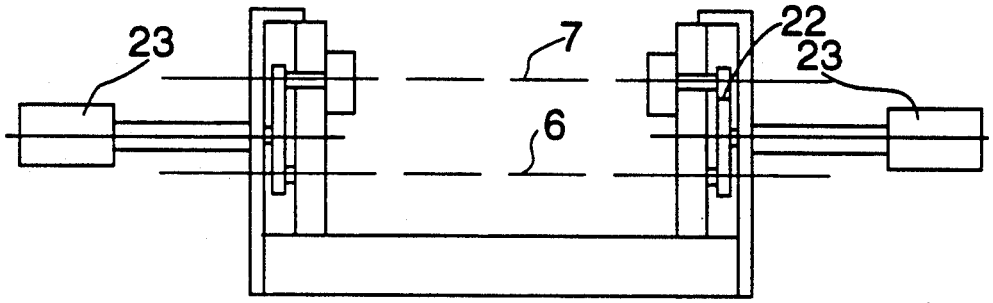

FIG. 4 shows two hydraulic cylinders 23 mounted on each side of the furnace, each of which acts upon both the moveable grate bar row 7 and the fixed grate bar row 6 through transverse linkages 22 which connect the action of hydraulic cylinders 23 to the rams 3, 4 associated with the fixed grate bar rows 6 and moveable grate bar rows 7, respectively.

Figure 5:
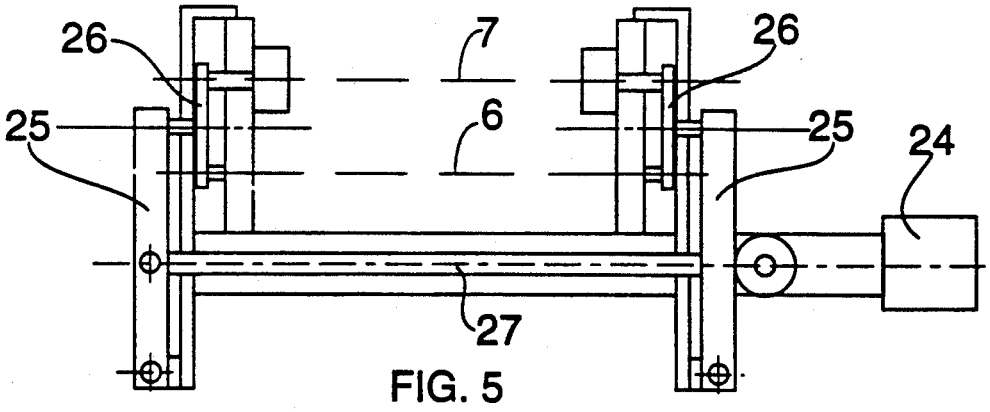

FIG. 5 shows an incineration grate in which a single hydraulic cylinder 24 mounted on only one side of the furnace acts upon rams on both ends of the grate bar rows 6, 7 by means of a longitudinal linkage 27 which extends the width of the furnace and transfers the hydraulic force through pressure bars 25 and transverse linkages 26 to the rams that clamp grate bar rows 6, 7.

Thus, while there have been shown and described and pointed out fundamental novel features of the invention as applied to a preferred embodiment thereof, it will be understood that various omissions and substitutions and changes in the form and details of the disclosed apparatus, and in its operation, may be made by those skilled in the art without departing from the spirit of the invention. It is the intention, therefore, to be limited only as indicated by the scope of the claims appended hereto.

What is claimed is:

1. A grate bar assembly for use in a combustion furnace, particularly, a waste incinerator including a combustion chamber, comprising:

a plurality of overlapping rows of grate bars extending across said combustion chamber, each row of grate bars being composed of a plurality of juxtaposed grate bars;

means for supporting said rows of grate bars; and means disposed outside said combustion chamber for releaseably and laterally clamping said plurality of overlapping rows of grate bars and for moving said juxtaposed grate bars toward each other.

2. The grate bar assembly according to claim 1, wherein said clamping means is hydraulically driven.

3. The grate bar assembly according to claim 1, wherein said grate bar support means comprises a support shield for supporting said plurality of rows of grate bars.

4. The grate bar assembly according to claim 1, additionally comprising means for individually controlling said clamping means for each one of said rows of grate bars.

5. The grate bar assembly according to claim 1, wherein said grate bar support means further comprises a pressure plate for connecting two of said rows of grate bars.

6. The grate bar assembly according to claim 5, wherein said plurality of rows of grate bars comprises a plurality of fixed grate bars and wherein said pressure plate connects two of said fixed rows of grate bars.

7. The grate bar assembly according to claim 1, wherein each of said plurality of rows of grate bars has two lateral ends and wherein said clamping means are disposed on said lateral ends of said rows of grate bars.

8. The grate bar assembly according to claim 1, wherein said plurality of rows of grate bars comprises a fixed row of grate bars and a moveable row of grate bars; and further comprising a linkage connected to said clamping means and coupling said fixed and said moveable rows of grate bars.

9. The grate bar assembly according to claim 1, wherein said plurality of rows of grate bars comprises a fixed row of grate bars and a moveable row of grate bars, each of said rows having a first and second end; and additionally comprising means engaged with said clamping means for connecting respective ones of said first and second ends of said fixed and moveable rows of grate bars for simultaneous movement therewith.

10. The grate bar assembly according to claim 1, additionally comprising means for measuring the movement of said grate bars.

11. A method for laterally adjusting the clearance of grate bars of a combustion furnace particularly a waste incinerator having a plurality of overlapping rows of grate bars with clearances therebetween, said method comprising:

cyclically and laterally applying and releasing a clamping force against said grate bars.

12. The method according to claim 11, wherein said plurality of rows comprises a row of grate bars which is oscillating through a phase of movement and a phase of still stand and wherein said clamping force is applied during said phase of still stand of said row of grate bars.

* * * * *